United States Patent [19]

Milburn, Jr.

[11] Patent Number: 4,610,609

[45] Date of Patent: Sep. 9, 1986

[54] SEALING APPARATUS FOR DEVICE HAVING VARIABLE VOLUME CHAMBERS

[76] Inventor: William W. Milburn, Jr., 945 Ninth St., Boulder, Colo. 80302

[21] Appl. No.: 618,597

[22] Filed: Jun. 8, 1984

[51] Int. Cl.[4] ..... F04B 29/00; F16J 9/22

[52] U.S. Cl. ..... 417/466; 417/534; 92/177; 92/248

[58] Field of Search ..... 417/463, 466, 534; 92/177, 248, 249, 251, 252; 91/173; 418/1, 61 R

[56] References Cited

U.S. PATENT DOCUMENTS

| | | | |
|---|---|---|---|
| 570,528 | 11/1896 | Wyeth | 92/177 |
| 1,844,181 | 2/1932 | Rosen | 417/463 |
| 2,081,040 | 5/1937 | King | 92/253 |
| 2,459,388 | 1/1949 | Munroe et al. | 417/466 |
| 3,040,712 | 6/1962 | Harrah | 92/248 |
| 3,104,618 | 9/1963 | Holdener | 417/466 |
| 3,630,646 | 12/1971 | Connolly | 417/466 |
| 4,068,986 | 1/1978 | Todorovic | 418/61 R |
| 4,214,507 | 7/1980 | Hock | 92/249 |
| 4,219,315 | 8/1980 | Sarich | 418/61 R |

FOREIGN PATENT DOCUMENTS

| | | | |
|---|---|---|---|
| 962962 | 8/1964 | United Kingdom | 417/466 |

*Primary Examiner*—William L. Freeh
*Attorney, Agent, or Firm*—O'Rourke & Harris

[57] ABSTRACT

A sealing apparatus is disclosed for a device having variable volume chambers formed by the walls of a case and a piston. The device includes a piston assembly having an outer piston structure with an inner piston structure therein. The inner piston structure is mounted on an eccentric on a crank shaft, the rotation of which causes nutating movement of the inner piston structure and a reciprocal linear movement of the outer piston structure. First sealing elements are mounted on the outer piston structure to provide sealing for the chambers having the outer piston structure forming part of the chambers, and second sealing elements are mounted on the ported faces of the inner piston structure to provide sealing for the chambers having the inner piston structure forming part of the chambers. Each sealing element includes one portion received in grooves in the piston structures and another portion with a plurality of spaced raised sections which engage the case walls. Dams are provided in the first sealing element, O rings are also provided around the eccentric for sealing, and nutation guides are provided to assure nutating movement of the inner piston structure.

13 Claims, 6 Drawing Figures

SEALING APPARATUS FOR DEVICE HAVING VARIABLE VOLUME CHAMBERS

FIELD OF THE INVENTION

This invention relates to sealing apparatus for a device having variable volume chambers, and, more particularly, relates to sealing apparatus for a device having inner and outer pistons that effectively move in reciprocal directions transverse to one another through nutational movement of the inner piston.

BACKGROUND OF THE INVENTION

Variable volume devices utilized as pneumatic or fluid motors, compressors, internal or external combustion engines, and the like are known in many variations and configurations. In positive displacement devices, for example, the use of a reciprocating piston fitted into a cylinder and sealed by means of rings extending circumferentially around the piston is well known.

Other arrangements having apparent advantages, due, at least in part, to the mechanical configurations utilized, have also heretofore been suggested and/or utilized, such as the Wankel rotary engine, for example. Such arrangements have not, however, proved to be complete successful, and have been found to have drawbacks in the sealing utilized between the static and moving components.

In addition, a relatively old design by Root has also been proposed, and this design suggests the use of inner and outer rectangular pistons moving in transverse directions to vary the volumes of a plurality of rectangular chambers. Examples of such a structure can be found, for example, in U S. Pat. No. 2,013,862 and British Patent No. 479,705.

The advantages of light weight relative to displacement, compactness, simplicity of parts, etc. of a device based upon Root's design are readily apparent. However, despite these apparent advantages, no widely accepted utilization of such a design has resulted, and it is felt that this lack of practical application is attributable, at least in part, to the difficulty of effectively sealing the chambers of such devices. In this respect, it should be noted that with a reciprocating cylindrical piston the greatest forces are transverse to the direction of sealing, while with a rectangular piston arrangement substantial force is encountered at the sealing area between the inner and outer pistons and this complicates the task of providing effective and efficient sealing therebetween.

Sealing apparatus providing a useful sealing arrangement for piston structures reciprocated in directions transverse to one another is shown and claimed in copending U.S. patent application Ser. No. 332,502, filed Nov. 18, 1981, and issued Aug. 21, 1984 as U.S. Pat. No. 4,466,335, by the inventor of this invention. In addition, nutation valving apparatus is shown and claimed in U.S. patent application Ser. No. 474,829, now issue 1/13/86, filed Mar. 14, 1983, by the inventor of this invention.

SUMMARY OF THE INVENTION

This invention provides improved sealing apparatus for a device having variable volume chambers. In particular, this invention provides an improved sealing apparatus having a plurality of case engaging raised portions and a portion received in grooves of both inner and outer pistons for efficiently sealing the chambers as the inner and outer pistons reciprocate in directions transverse to one another by causing nutational movement of the inner piston. Nutational movement of the inner piston is assured by nutation guides, and sealing is further enhanced by O rings on an eccentric used to cause nutational movement of the inner piston during rotation of the shaft having the eccentric mounted thereon.

It is therefore an object of this invention to provide an improved sealing apparatus for a device having variable volume chambers.

It is another object of this invention to provide an improved sealing apparatus for a device having chambers the volumes of which are varied by inner and outer pistons reciprocating in directions transverse to one another.

It is still another object of this invention to provide an improved sealing apparatus having a plurality of case engaging raised portions and a portion received in grooves in each piston.

It is yet another object of this invention to provide a improved sealing gasket with spaced raised portions.

It is still another object of this invention to provide an improved sealing apparatus with nutating guides cooperable with the inner piston to assure nutating movement of the inner piston.

With these and other objects in view, which will become apparent to one skilled in the art as the description proceeds, this invention resides in the novel construction, combination, and arrangement of parts as hereinafter described and more particularly defined by the appended claims, it being understood that changes are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 3:
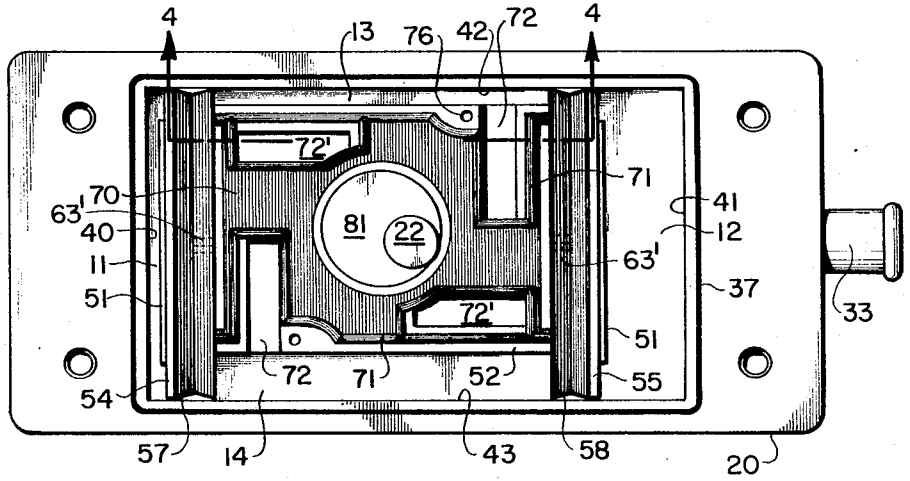
FIG. 3 is a side sectional view of the pump device shown in FIGS. 1 and 2 to illustrate the improved sealing apparatus of this invention.

Referring to the drawings, a fluid pump 9 having variable volume chambers, such as chambers 11, 12, 13 and 14 as best shown in FIG. 3, is utilized herein to illustrate the invention. It is to be understood, however, that the sealing apparatus of this invention could be utilized in other devices and structures having similar operating structure. It is also to be understood that piston assembly 16 and outer casing 17 of pump 9 include symmetrical, or mirror image, structures such that illustration and description of one-half will fully illustrate the corresponding other one-half which is not shown in detail in the drawings, and where reference is made to the illustrated half, it is to be understood that such reference also applies to the mirror image structure of the other half.

Figure 1:
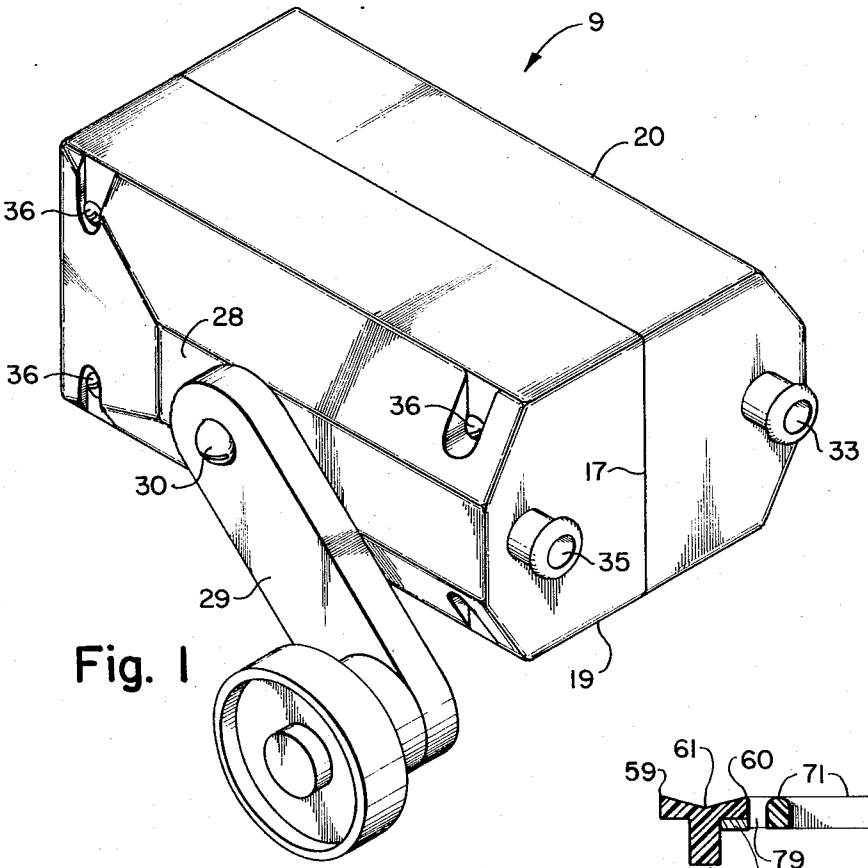
FIG. 1 is a perspective view of a pump device utilizing a nutating structure and incorporating the improved sealing apparatus of this invention therein.
Figure 2:
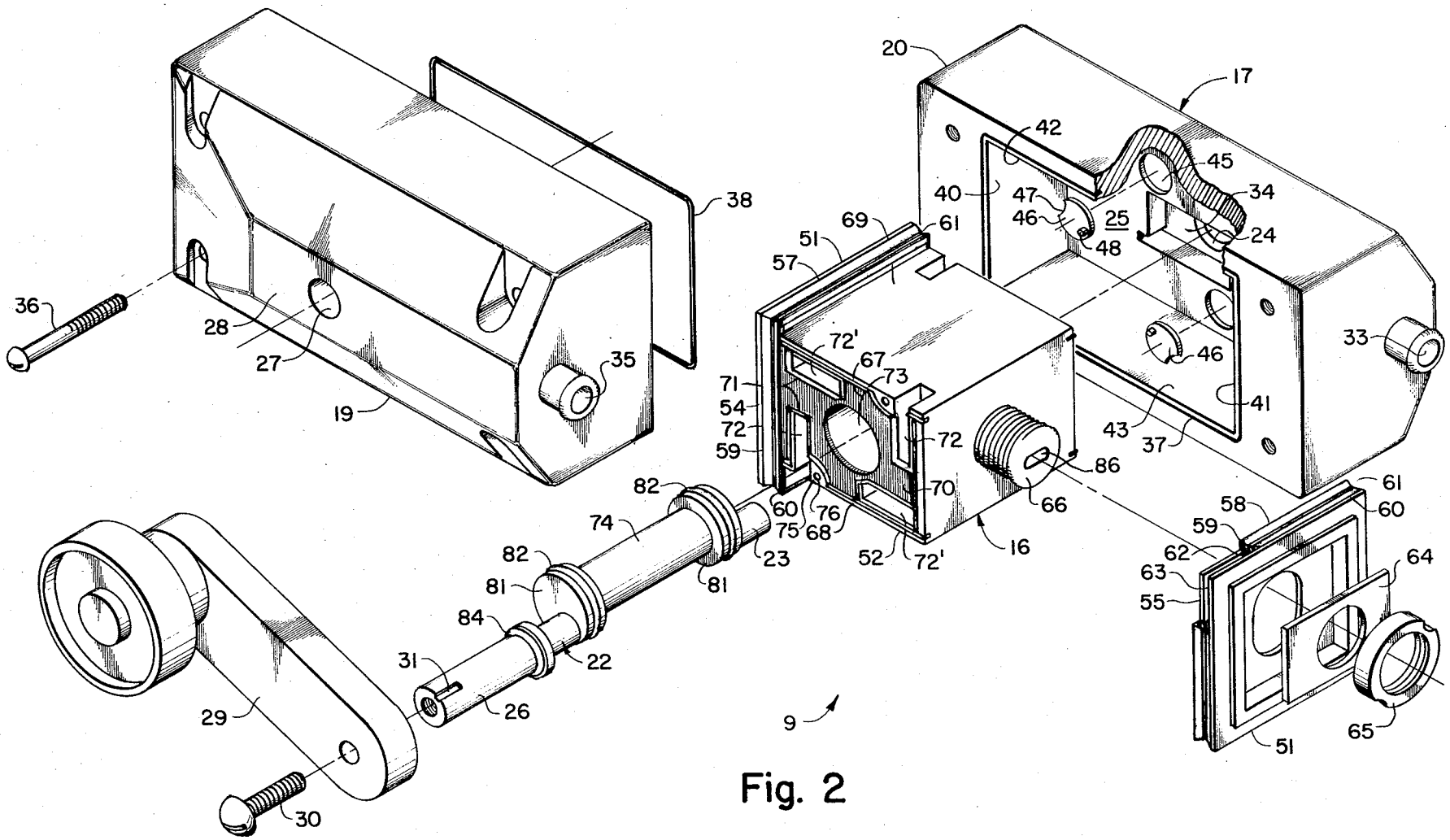
FIG. 2 is an exploded perspective view of the pump device shown in FIG. 1.

As best shown in FIGS. 1 and 2, rectangular casing 17 of pump 9 is formed from two hollow casing halves 19 and 20 with the casing halves being dimensionally identical but with some differences in detail as brought out below.

As shown in FIG. 2, crank shaft 22 is journalled within casing 17 with one end 23 being received in cylindrical notch 24 of side wall 25 of casing half 20 and the other end 26 extending through aperture 27 in side wall 28 of casing half 19 where it is attached to crank shaft handle 29 by bolt 30. The handle engaging end 26 of shaft 22 has grooves 31 therein to receive mating splines (not shown) in the handle to prevent slippage during rotation of the handle and shaft.

An inlet port 33 is provided on casing half 20 to receive fluid to be pumped, with the fluid being conducted through passage 34 to the variable volume chambers 11, 12, 13 and 14 in timed relationship to rotation of crank shaft 22. An exhaust, or outlet, port 35 is provided in like manner in casing half 19 to exhaust pumped fluid from the pump. The inlet and exhaust ports are to be understood as relative terms, each capable of fullfilling the opposite function by reversing the direction of rotation of crank handle 29 and shaft 22.

To assemble casing halves 19 and 20, the casing halves are positioned as shown in FIG. 1, and then fastened together by screws 36. To provide a seal between casing halves, casing half 19 preferably includes a rib (not shown) thereon which is received in groove 37 of casing half 20, with a gasket 38 being preferably provided in the groove.

As best shown in FIGS. 2 and 3, the inner walls of casing 17 provide chamber walls 40 and 41 for outer chambers 11 and 12, chamber wall 42 and 43 for inner chambers 13 and 14, and porting walls 28 and 25 with wall 28 having aperture 27 therein through which shaft 22 extends, and wall 25 having cylindrical groove 24 therein for receiving end 23 of shaft 22. In addition, walls 28 and 25 have cylindrical grooves 45 therein to receive nutation guides 46 which guides include a disk 47 received in grooves 45 and pins 48 which extend from the periphery of the disks.

Figure 4:
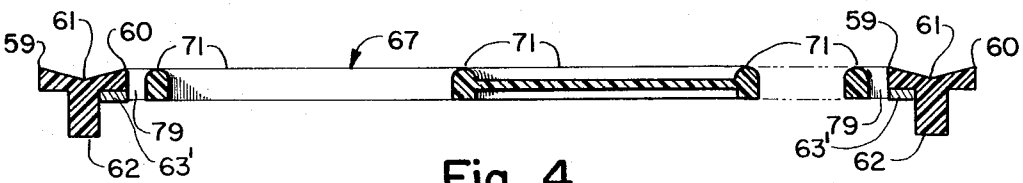
FIG. 4 is a cut-away view taken along lines 4—4 of FIG. 3.

Piston assembly 16 includes an outer piston structure, or assembly, 51 and an inner piston structure, or assembly, 52, with outer piston structure 51 and inner piston structure 52 being first and second work pieces, respectively. Outer piston structure 51 includes two spaced outer piston walls 54 and 55, which have rectangular sealing gaskets 57 and 58 respectively, mounted thereon at the periphery to engage the inner surfaces of adjacent casing walls 25, 28, 42 and 43. As shown in FIGS. 2 and 3, sealing gaskets 57 and 58 have a V-shaped cross-section so that raised portions 59 and 60 engage the casing walls with a recess 61 between the raised portions 59 and 60. In addition, inwardly directed tab or dam, 62, as shown best in FIG. 4, extends inwardly to be received within groove 63 in the periphery of walls 54 and 55, and shoulders, or dams 63' extend from tab 62 outwardly under raised portion 59 or 60 (as shown in FIGS. 3 and 4) that extend toward inner piston structure 52. Shoulders 63' comprise three narrow protrusions that extend transverse to raised portion 60 and are centrally positioned and spaced from one another as indicated in FIG. 3. Shoulders 63' block the axial flow of fluid under raised portion 60.

Inner piston structure 52 is received within outer piston structure 51 and is retained between outer piston walls 54 and 55 by limiting washers 64 and nuts 65 on threaded protrusions 66 at each end of inner piston structure 52.

Figure 6:
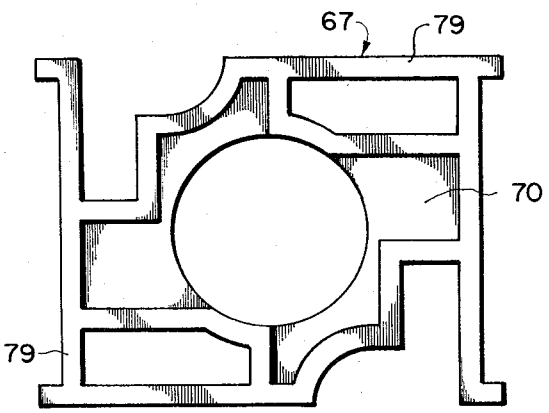
FIG. 6 is a back side view of the back side of the gasket for the inner piston assembly.

Inner piston structure 52 has inner piston sealing gaskets 67 at each porting face 68 (which porting faces are normally positioned with respect to chamber faces 69 as shown in FIG. 2). As indicated in FIGS. 2 and 3, sealing gasket 67 entirely covers each porting face 68 except for areas needed for porting, shaft extension, and guide placement. Gaskets 67 include a body portion 70 that has raised portions 71 extending therefrom along the longitudinal edges of porting faces 68, around ports 72 and 72' and along nutation guide cut-outs 75, which cut-outs include a small aperture 76 to receive pin 48 of nutation guides 46. In addition, as indicated by FIGS. 4, 5 and 6, porting faces 68 have grooves 78 therein to receive dam portion 79 of gaskets 67 therein.

Inner piston structure 52 has a central aperture 73 to receive eccentric 74, and inner piston structure 52 is mounted on eccentric 74 on crank shaft 22 by means of shoulders 81 having O rings 82 received in grooves at the periphery of the shoulders. Shoulders 81 are positioned adjacent to porting faces 68 of the inner piston structure. In addition, O ring 84 is provided on shaft 22 adjacent to wall 28 of case half 19 for sealing purposes, and ports 86, which extend through protrusions 66 to chambers 11 and 12, communicate with ports 72'.

As eccentric 74 is rotated by shaft 22, inner piston structure 52 is moved in a circle of nutation which causes the outer piston structure to be moved linearly so that relative reciprocal movement thus occurs in transverse directions between the inner and outer piston assemblies. This results in chamber 14 being fully compressed and chamber 13 being at maximum value at one rotational position of crank 29, with chamber 12 being fully compressed and chambers 11 being at maximum volume when crank 29 is rotated 90°, with chamber 13 being fully compressed and chamber 14 being at maximum volume when crank 29 is rotated another 90°, and with chamber 11 being fully compressed and chamber 12 being at maximum volume when crank 29 is rotated still another 90°. A nutating arrangement, as described herein is shown in greater detail in U.S. patent application Ser. No. 322,502, filed Nov. 18, 1981 by the inventor named herein, issued Aug. 21, 1984 as U.S. Pat. No. 4,466,335, and incorporated herein by reference.

Figure 5:
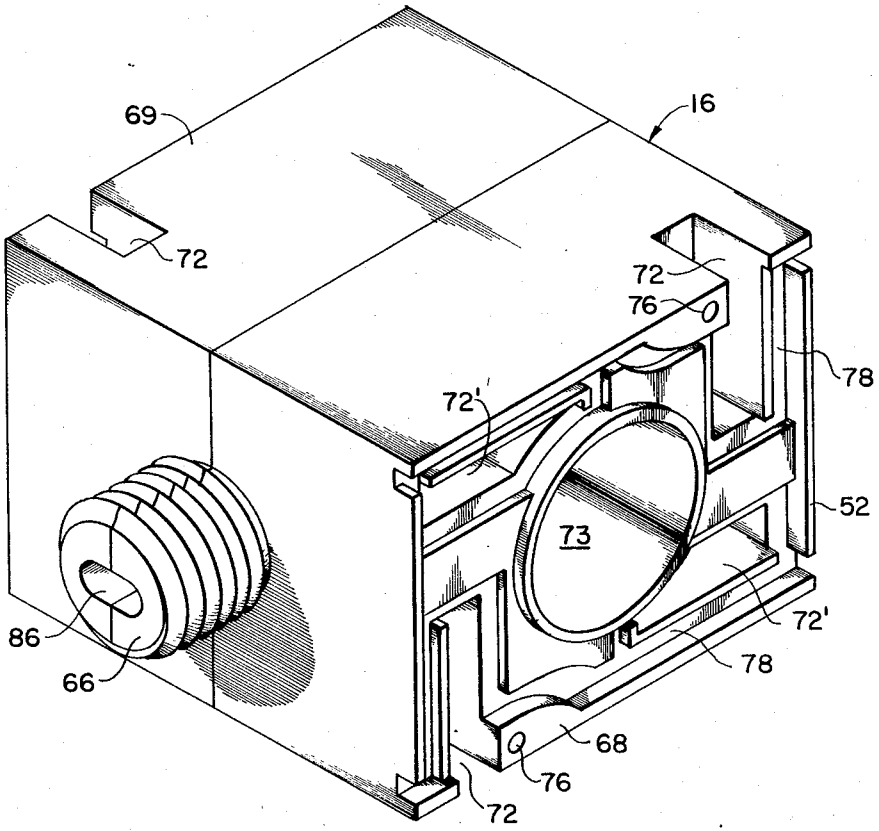
FIG. 5 is a perspective view of the inner piston assembly of the pump device shown in FIGS. 1 through 4 and illustrating one ported face of the inner piston assembly.

As can best be seen from FIGS. 2 and 5, ports 72 and 72' are selectively and sequentially brought into communication with passage 34 as shaft 22 and crank 29 are rotated to allow fluid to the outer compartment, or chamber, at least at maximum valve, and to expel fluid from the compartment as the volume is reduced toward minimum volume. The timing relationship is established by rotation of shaft 22 which rotates eccentric 74 to move inner piston assembly 51 about a circle of nutation. This means, in essence, that ports 72 and 72' move in a circle of nutation and are selected, in conjunction with passage 34 to open and close communication therebetween. As shown in FIG. 2, each port 72 and 72' communicates with one of the chambers so that each chamber is selectively and sequentially brought into and out of communication with the inlet and outlet. Operation and timing of a nutating valving arrangement is shown in greater detail in U.S. patent application Ser.

No. 474,829, filed Mar. 14, 1983 by the inventor named herein.

By way of further clarification, and with reference to the drawings, inlet and outlet ports 33 and 35 provide fluid to and carry fluid away from the pump. These ports communicate through passage 34 to the variable volume chambers 11, 12, 13 and 14 by means of the nutation valving arrangement formed essentially by end walls 25 and 28 and piston chamber faces 68 (which faces have sealing means 67 thereon). As shown in FIG. 2, for example, end walls 25 and 28 have an aperture therein which is brought into communication with ports 72 and 72'. The porting faces are moved, relative to the adjacent end walls 25 and 28, as shaft 22 and crank 29 are rotated to allow fluid to be selectively introduced into each chamber and later expelled therefrom to thus create the pumping action.

More particularly, piston assembly 16 has an outer piston assembly 51 with two spaced outer piston walls 54 and 55, each of which has a rectangular sealing gasket (57 and 58) thereon to engage the inner surfaces of adjacent casing walls 25, 28, 42 and 43. Chambers 11 and 12 are formed between walls 40 and 41 and piston walls 54 and 55 and are varied in volume as the outer pistons are moved toward and away from end walls 40 and 41.

Piston assembly 16 also has an inner piston structure 52 within outer piston structure 51. Inner piston structure 52 has faces 69 thereon, which faces, in conjunction with walls 42 and 43, have chambers 13 and 14 formed therebetween. Chambers 13 and 14 are varied in volume as the inner pistons are moved upwardly and downwardly toward and away from the top and bottom walls 42 and 43.

As also shown best in FIGS. 2, 3 and 5, the inner piston assembly 52 also has porting faces 68, which faces have gaskets 67 thereon and have ports 72 and 72' therein (for establishing valving ports for communication with the chambers) and a central aperture 73 to receive eccentric 74 for actuating the piston assembly with piston motion being imparted by shaft 22 having the eccentric 74 thereon.

Thus, as shaft 22 is rotated, this causes eccentric 74 to impart motion to both the inner and outer piston assemblies. While the movement of the inner and outer pistons are toward and away from the adjacent walls to vary the volumes of the chambers, the porting faces 68 (having eccentric 74 received in the central aperture 73 thereof) are moved in a nutating motion.

Rectangular sealing gaskets 54 and 55 are preferably formed of a compressible material, such as soft rubber, but could, under more demanding conditions, include various other compressible materials. In any event, the two spaced raised surfaces 59 and 60 engage the casing walls to provide an effective seal thereat for chambers 11 and 12. In addition, dam portion 62 of gaskets 54 and 55 are received in grooves 63 in the outer piston walls and prevent fluid escape beneath the gaskets when the gaskets are subjected to compressive forces. Gaskets 67 at ported faces 68 of the inner piston assembly are also preferably formed of a material such as that of gaskets 54 and 55. Casing 17, as well as handle 29 are preferably formed of plastic, although other materials could be utilized. The piston assembly is also formed from plastic material, but again other materials can be utilized as found necessary or desirable for a particular application.

As can be appreciated from the foregoing, this invention provides an improved sealing apparatus for a device having a plurality of variable volume chambers.

What is claimed is:

1. In a device having wall means defining a work chamber and first and second work pieces within said chamber to vary the volume of first and second compartments within said chamber with said first and second work pieces being moveable in different directions with respect to one another, apparatus comprising:

first sealing means mounted on one of said first work piece and said wall means and engaging the other of said first work piece and said wall means to provide a seal for said first compartment thereat;

second sealing means mounted on one of said second work piece and said wall means and engaging the other of said second work piece and said wall means to provide a seal for said second compartment thereat, at least one of said first and second sealing means including a plurality of raised portions engaging said other of said work pieces and said wall means; and nutation guides mounted on one of said wall means and said second work piece and engaging the other of said wall means and said second work piece to constrain travel of said work piece in a predetermined manner, with said second work piece being constrained by said nutation guides to move in a circle of nutation about said nutating guides, and with said second work piece being mounted on a shaft imparting nutating movement to said second work piece.

2. The apparatus of claim 1 wherein one of said shaft and said second work piece has a plurality of sealing rings mounted thereon and engaging the other of said shaft and said second work piece to form a seal therebetween.

3. The apparatus of claim 1 wherein said plurality of raised portions of said first and second sealing means are formed from a single piece of compressible material having a recessed inner portion between said raised portions.

4. The apparatus of claim 3 wherein said piece of compressible material of said first sealing means has a tab protruding away from said recessed inner portion and shoulder means extending away from said tab portion and one of said raised portions.

5. The apparatus of claim 3 wherein said piece of compressible material of said second sealing means has a recessed body portion and raised portions formed as ridges on said body portion with said ridges being small relative to said body portion.

6. In a device having a work chamber defined by chamber wall means including first and second pairs of substantially parallel walls with each wall of each pair being substantially normally positioned with respect to each wall of the other pair and with said second wall pair having port means therein, first and second work pieces with said first work piece varying the volume of first and second oppositely positioned compartments within said chamber and said second work piece varying the volume of third and fourth oppositely positioned compartments within said chamber with each of said work pieces having wall means with spaced edges adjacent to said chamber wall means and with said wall means of said second work piece having port means therein communicable with said port means of said second wall pair, and a shaft having said second work piece mounted thereon, with said first and second work pieces being positioned to allow reciprocal movement in normal directions with respect to one another upon rotation of said shaft with said first work piece moving in a direction parallel and closely adjacent to said wall means and said second work piece moving in a circle of nutation, apparatus comprising:

first sealing means mounted on said first work piece and engaging said first and second wall pairs to provide a seal for said first and second compartments thereat, said first sealing means including a pair of spaced gaskets, each of which includes raised portions with a recess therebetween;

second sealing means mounted on said second work piece and engaging said second wall pair to provide a seal for said third and fourth compartments thereat, said second sealing means including a central body portion having raised portions at said edges and port means; and third sealing means mounted on said shaft adjacent to said third and fourth compartments to form a seal thereat, said third sealing means including O rings adjacent to said wall means of said second work piece.

7. The apparatus of claim 6 wherein said shaft includes an eccentric having said second work piece and said third sealing means mounted thereon, wherein said second wall pair has nutation guides thereon with pins extending therefrom, and wherein said wall means of said second work piece has receiving means therein to receive said pins of said nutation guide so that upon rotation of said shaft said second work piece is caused to move in a circle of nutation about said guides.

8. The apparatus of claim 6 wherein said first work piece has a notch therein, and wherein said first sealing means includes a gasket having a substantially V-shaped configuration in engagement with said first and second wall pairs, a dam received in said notch of said first work piece, and shoulder means extending from said dam to block longitudinal flow of fluid along said dam.

9. The apparatus of claim 6 wherein said second sealing means substantially entirely covers the portion of said wall means of said second work piece facing said second wall pairs, and wherein said raised portions at least partially surround said port means and extend at least partially around said central body portion at said edges of said portion of said wall means of said second work piece facing said second wall pair.

10. An apparatus for a fluid pump having an inner piston structure with opposing ported walls and opposing chamber wall and an outer piston structure having opposing chamber walls, said inner piston structure having grooved portions on said ported walls and said opposing chamber walls of said outer piston structure having grooved portions at the outer edges thereof, both said inner piston structure and said outer piston structure being disposed within a case having case walls so that said ported walls of said inner piston structure and said outer edges of said chamber walls of said outer piston structure are continuously operationally adjacent case walls, and wherein said inner piston structure and said outer piston structure cooperate with said case walls to form four variable volume chambers within said case, said apparatus comprising:

a first gasket with oppositely directed portions one of which is received in said grooved portions of said outer piston structure and the other of which engages said case walls adjacent to said opposing chamber walls and said ported walls of said inner piston structure;

a second gasket with oppositely directed portions one of which is received in said grooved portions of said inner piston structure and the other of which engages said case walls adjacent to said opposing ported walls of said inner piston structure;

a shaft extending through said ported walls of said inner piston with said inner piston structure being mounted on said shaft; and shaft sealing means mounted on said shaft adjacent to said ported walls.

11. The apparatus of claim 10 wherein said apparatus includes nutation guides mounted on said case wall and urging said ported wall of said inner piston structure.

12. In a device comprising an outer case defining a substantilly closed six sided rectilinear chamber, an outer piston having an inner rectilinear opening disposed in said rectilinear chamber and having compartment faces which in conjunction with said outer case define first and second compartments the volumes of which are varied by linear reciprocal movement of said outer piston, an inner piston disposed within said outer piston opening and having ported faces and compartment faces which in conjunction with said outer case define third and fourth compartments the volumes of which are varied by reciprocal movement of said inner piston in a second direction transverse to said first direction, a shaft having an eccentric member thereon with said eccentric member extending through said ported faces of said inner piston and being connected with said inner piston to produce a rotary motion of said inner piston to effect said reciprocal motion of said inner piston within said outer piston and to cause said reciprocal motion of said outer piston within the case, and valve means to selectively open and close fluid channels to said compartments, apparatus comprising:

grooves defined adjacent to and around said compartment faces of said outer piston;

a rectangular sealing ring having a dam portion received in each said groove of said outer piston and a sealing portion between said outer piston and the adjacent outer case wall with said sealing portion having a plurality of spaced segments each of which engage said adjacent outer case wall;

grooves in said ported faces of said inner piston extending at least around the ports defined in said ported faces, said eccentric, and the perimeter of said inner piston;

a gasket having a first portion received in said grooves in said ported face of said inner piston and a second portion with raised surfaces adjacent to said ports, eccentric, and perimeter of said inner piston with said gasket forming a seal between said ported faces of said inner piston and said adjacent outer wall;

grooves in said eccentric adjacent to said ported faces; and

O rings positioned in said grooves in said eccentric in a sealing relationship with said inner piston.

13. The apparatus of claim 12 wherein said outer case has four recesses therein adjacent to said ported faces of said inner piston, and wherein circular nutation guide is mounted in each of said recesses in said outer case, said nutation guides each having a portion engaging said ported faces whereby said inner piston is constrained to movement about a circle of nutation determined by said nutation guides.

* * * * *